US010371408B2

(12) United States Patent
Papas et al.

(10) Patent No.: US 10,371,408 B2
(45) Date of Patent: Aug. 6, 2019

(54) FLAME ARRESTORS FOR USE WITH A HVAC/R SYSTEM

(71) Applicant: Carrier Corporation, Farmington, CT (US)

(72) Inventors: Paul Papas, West Hartford, CT (US); Parmesh Verma, Manchester, CT (US); Richard G. Lord, Murfreesboro, TN (US); William F. Walter, Fayetteville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 276 days.

(21) Appl. No.: 14/903,850

(22) PCT Filed: Jul. 15, 2014

(86) PCT No.: PCT/US2014/046693

§ 371 (c)(1),
(2) Date: Jan. 8, 2016

(87) PCT Pub. No.: WO2015/009721

PCT Pub. Date: Jan. 22, 2015

(65) Prior Publication Data

US 2016/0153678 A1 Jun. 2, 2016

Related U.S. Application Data

(60) Provisional application No. 61/846,272, filed on Jul. 15, 2013.

(51) Int. Cl.
*F24F 11/89* (2018.01)
*A62C 4/02* (2006.01)
(Continued)

(52) U.S. Cl.
CPC ..... *F24F 11/89* (2018.01); *A62C 4/02* (2013.01); *F24F 11/30* (2018.01); *F24F 11/35* (2018.01)

(58) Field of Classification Search
CPC ..... F24F 11/02; F24F 11/0086; F24F 2011/0098; F24F 11/89; A62C 4/02
See application file for complete search history.

(56) References Cited

U.S. PATENT DOCUMENTS 3,711,259 A * 1/1973 Gurney ..... A62C 4/00 138/42
3,989,097 A * 11/1976 Schildknecht ..... F24F 3/14 165/228

(Continued)

FOREIGN PATENT DOCUMENTS

CN 102039017 A * 5/2011
CN 102695403 A 9/2012

(Continued)

OTHER PUBLICATIONS

International Searching Authority, PCT International Search Report, PCT/US2014/046693, dated Jan. 22, 2015.

(Continued)

*Primary Examiner* — Emmanuel E Duke
(74) *Attorney, Agent, or Firm* — Cantor Colburn LLP

(57) ABSTRACT

An HVAC/R system including an HVAC component configured to allow a flammable refrigerant to flow therethrough, at least one supply flame arrestor positioned within the supply air steam, and at least one return flame arrestor positioned within the return air stream, wherein each flame arrestor includes an open area greater than 60%.

29 Claims, 4 Drawing Sheets

(51) Int. Cl.
*F24F 11/30* (2018.01)
*F24F 11/35* (2018.01)

(56) References Cited

U.S. PATENT DOCUMENTS

| | | | | |
|---|---|---|---|---|
| 3,999,936 | A | 12/1976 | Hasselmann | |
| 4,975,098 | A * | 12/1990 | Lee | A62C 4/02 431/346 |
| 5,351,037 | A | 9/1994 | Martell et al. | |
| 5,415,233 | A | 5/1995 | Roussakis et al. | |
| 6,467,271 | B2 | 10/2002 | Youn | |
| 6,743,279 | B2 * | 6/2004 | Cataldo | B01D 47/06 422/28 |
| 7,241,137 | B2 | 7/2007 | Leinemann et al. | |
| 7,730,735 | B2 | 6/2010 | Maruya et al. | |
| 7,740,184 | B2 * | 6/2010 | Schnell | F24F 3/14 165/222 |
| 7,874,178 | B2 | 1/2011 | McConnell et al. | |
| 8,092,213 | B2 | 1/2012 | Leinemann | |
| 2006/0286921 | A1 * | 12/2006 | Arts | F24F 3/1603 454/187 |
| 2008/0164038 | A1 | 7/2008 | Reade | |
| 2010/0071326 | A1 * | 3/2010 | Alexander | B01D 39/1615 55/514 |
| 2010/0071327 | A1 * | 3/2010 | Alexander | B01D 39/1615 55/514 |
| 2010/0243767 | A1 | 9/2010 | Mori et al. | |
| 2010/0311001 | A1 | 12/2010 | Helmsen et al. | |
| 2012/0096879 | A1 * | 4/2012 | Lam | B64D 37/32 62/93 |
| 2012/0119136 | A1 * | 5/2012 | Yana Motta | C09K 5/045 252/67 |
| 2012/0199312 | A1 * | 8/2012 | Zeng | A61L 9/014 165/11.1 |
| 2012/0242206 | A1 * | 9/2012 | Gasser | F24F 1/027 312/236 |
| 2013/0158714 | A1 * | 6/2013 | Barton | F24F 11/30 700/276 |
| 2013/0284464 | A1 * | 10/2013 | Koban | A62C 4/00 169/43 |
| 2014/0172400 | A1 * | 6/2014 | Majewski | G06F 17/5009 703/18 |

FOREIGN PATENT DOCUMENTS

| | | | |
|---|---|---|---|
| CN | 202630250 | U | 12/2012 |
| CN | 102941000 | A | 2/2013 |
| CN | 202762274 | U | 3/2013 |
| DE | 9103382 | U1 | 6/1991 |
| EP | 1023922 | A1 | 2/2000 |
| EP | 2503257 | A1 | 9/2012 |
| JP | H11268800 | A | 10/1999 |
| JP | 2005251431 | A | 9/2005 |
| WO | 2012097060 | A2 | 7/2012 |
| WO | WO2012097060 | A2 * | 7/2012 |

OTHER PUBLICATIONS

Pentair, Amal Deflagration / Detonation Flame Arresters.
Enardo, Flame Arrester Technology.
Chinese First Office Action and Search Report for applicaiton 201480040481.7, dated Dec. 6, 2017, 9 pages.
English Translation of Second Chinese Office Action w/Search Report for Chinese Patent Application No. 201480040481.7 (PCT/US2014/046693) dated May 16, 2018; 10 pgs.
Second Chinese Office Action for Chinese Patent Application No. 201480040481.7 (PCT/2014/046693) w/Search Report; 9 pgs.
Third Chinese Office Action with English Text for Application No. 201480040481.7 dated Oct. 24, 2018, 14 pgs.
Chinese Fourth Office Action for application 201480040481.7, dated Apr. 25, 2019, 11 pages.

* cited by examiner d = WIRE DIAMETER

S = MESH SPACING

FLAME ARRESTORS FOR USE WITH A HVAC/R SYSTEM

CROSS REFERENCE TO RELATED APPLICATION

The present application is related to, claims the priority benefit of U.S. Provisional Patent Application Ser. No. 61/846,272, filed Jul. 15, 2013 and PCT Application No. PCT/US2014/46693 filed Jul. 15, 2014. The content of this application is hereby incorporated by reference in its entirety into this disclosure.

TECHNICAL FIELD OF THE DISCLOSED EMBODIMENTS

The presently disclosed embodiments generally relate to heating, ventilation, air conditioning, and refrigeration (HVAC/R) systems, and more particularly, to a flame arrestor for use with a HVAC/R system.

BACKGROUND OF THE DISCLOSED EMBODIMENTS

Refrigeration systems, as used in HVAC/R applications, utilize a closed loop refrigerant circuit to condition air inside an interior space. Over the years, the HVAC industry has been using refrigerants with ozone depleting chlorofluorocarbons (CFCs) and hydrochlorofluorocarbons (HCFCs). Due to the Montreal Protocol, the use of ozone depleting refrigerants is being phased out of the industry.

New refrigerants have been developed to comply with environmental regulations relating to global warming potential (GWP). In order to comply with the proposed GWP regulations, hydrofluorocarbon (HFC) and hydrocarbon refrigerants with various levels of flammability are being developed and manufactured.

Flammable refrigerants used in HVAC/R applications may leak and migrate to undesirable areas in the vicinity of the HVAC/R system. When the flammable refrigerants, in the presence of air or another oxidizer, are exposed to an ignition source, the potential for combustion events exists. There is therefore a need for an HVAC/R system which mitigates the spread of a flame to other nearby combustible materials, mitigates the propagation of premixed deflagrations or explosions that can cause significant overpressure and structural damage in confined spaces, and/or quenches ignition of refrigerant-air mixtures which may pose a risk to occupants.

SUMMARY OF THE DISCLOSED EMBODIMENTS

In one aspect, a HVAC/R system is provided. The HVAC/R system includes an HVAC component configured to allow a refrigerant to flow therethrough, at least one supply flame arrestor positioned within the supply air stream, and at least one return flame arrestor positioned within the return air stream.

In one embodiment, the refrigerant includes a flammable refrigerant. In one embodiment, the flammable refrigerant may be difluoromethane (R32), and in another embodiment the flammable refrigerant may be 2,3,3,3-tetrafluoro-1-propene (R1234yf).

In one embodiment, the HVAC component includes a fan coil. In one embodiment, the fan coil includes an evaporator coil, a fan, and a heating element disposed within an enclosure. In one embodiment, the heating element includes an electrical heating element. In one embodiment, at least one supply conduit and at least one return conduit may be operably coupled to the HVAC component. In one embodiment, the at least one supply conduit includes a plurality of supply conduits. In one embodiment, the at least one supply flame arrestor is positioned within the supply air stream by disposing the at least one supply flame arrestor within the at least one supply conduit. In one embodiment, the at least one return flame arrestor is positioned within the return air stream by disposing the at least one return flame arrestor within the at least one return conduit.

In another embodiment, the HVAC component includes an evaporator coil operably coupled to a furnace. In one embodiment; the furnace includes a fan and a heating element disposed within an enclosure. In one embodiment, the heating element is selected from a group consisting of a flame and an electrical heating element. In one embodiment, at least one supply conduit and at least one return conduit may be operably coupled to the HVAC component. In one embodiment, the at least one supply conduit includes a plurality of supply conduits. In one embodiment, the at least one supply flame arrestor is positioned within the supply air stream by disposing the at least one supply flame arrestor within the at least one supply conduit. In one embodiment, the at least one return flame arrestor is positioned within the return air stream by disposing the at least one return flame arrestor within the at least one return conduit.

In another embodiment, the HVAC component includes a refrigeration unit. In one embodiment, the refrigeration unit includes an evaporator coil, at least one return air intake fan, at least one supply air channel, and a compressor. In one embodiment, the at least one return air intake fan is positioned within the return air stream and the at least one supply air channel is positioned within the supply air stream. In one embodiment, the at least one supply flame arrestor is positioned within the supply air stream by positioning the at least one supply flame arrestor adjacent to the at least one supply air channel. In one embodiment, the at least one return flame arrestor is positioned within the return air stream by positioning the at least one flame arrestor adjacent to the at least one return air intake fan.

In one embodiment, one or more of the at least one supply flame arrestor and the at least one return flame arrestor includes a mesh pitch of approximately 0.1 mm to 5 mm. In one embodiment, one or more of the at least one supply flame arrestor and the at least one return flame arrestor includes an open area greater than 60%. In one embodiment, one or more of the at least one supply flame arrestor and the at least one return flame arrestor includes a metal mesh. In another embodiment, one or more of the at least one supply flame arrestor and the at least one return flame arrestor includes a non-flammable fiber. In another embodiment, one or more of the at least one supply flame arrestor and the at least one return flame arrestor includes a non-flammable porous material.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
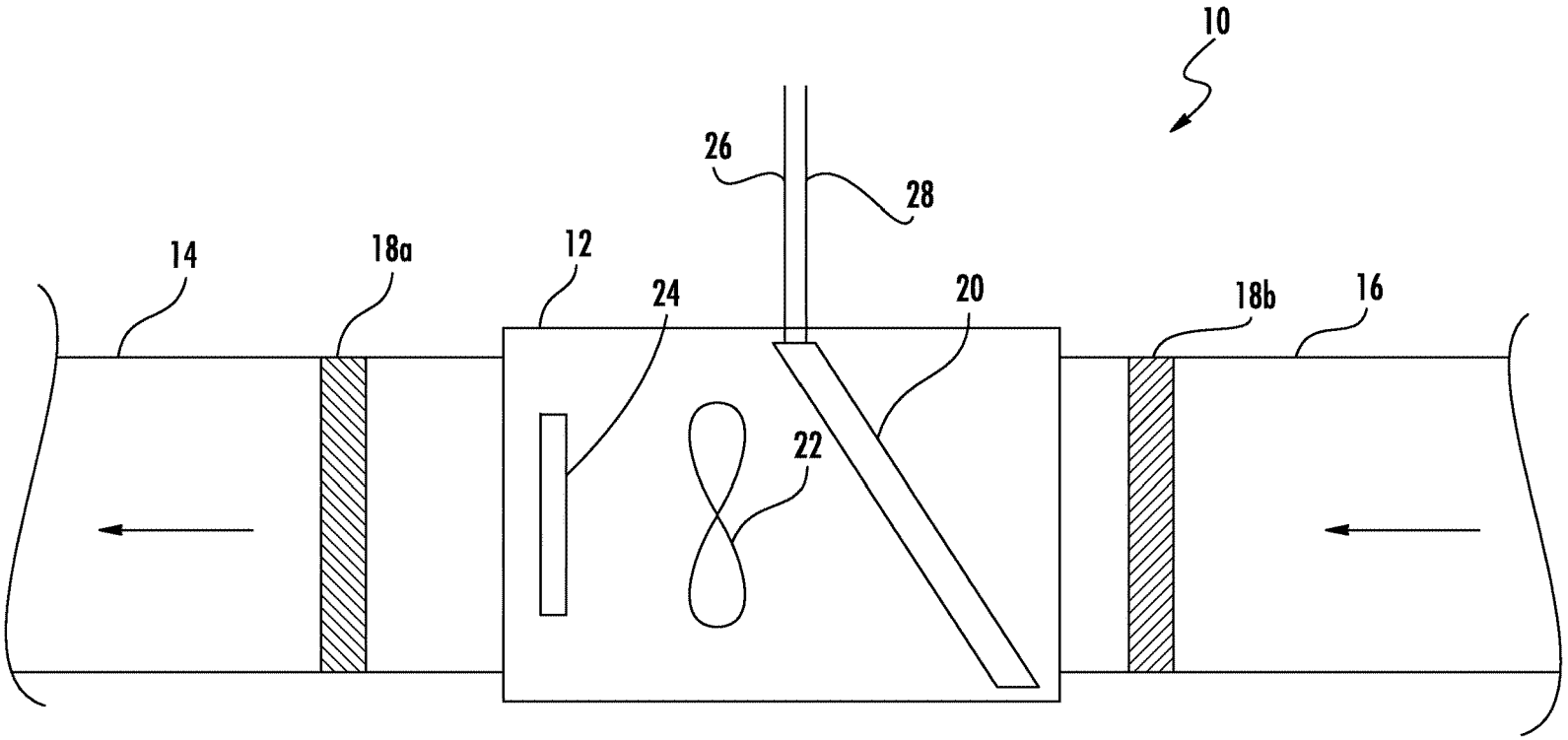
FIG. 1 is a schematic diagram of a HVAC/R system in an embodiment.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates a schematic diagram of a heating, ventilation, air conditioning, and refrigeration (HVAC/R) system in an embodiment of the present disclosure, indicated generally at 10. The HVAC/R system 10, depicted in a horizontal configuration, includes an HVAC component 12 configured to allow a refrigerant to flow therethrough, at least one supply flame arrestor 18*a* positioned within a supply air stream and at least one return flame arrestor 18*b* positioned within a return air stream. In one embodiment, the refrigerant may is a flammable refrigerant, such that the refrigerant has the ability to ignite and/or propagate a flame in the presence of air. The flammability of a refrigerant is determined under test conditions specified in the American Society of Testing and Materials (ASTM) E681. The composition of a refrigerant is evaluated at specific ambient conditions, including, but not limited to initial temperature, humidity, and pressure as designated by the American Society of Heating, Refrigeration, and Air-Conditioning Engineers (ASHRAE) Standard 34. In one embodiment, the flammable refrigerant includes difluoromethane (R32), and in another embodiment the flammable refrigerant includes 2,3,3,3-tetrafluoro-1-propene (R1234yf). It will be appreciated that other flammable refrigerants may be used within the HVAC/R system 10.

In the illustrated, non-limiting embodiment, the HVAC component 12 is a fan coil containing an evaporator coil 20, a fan 22 and a heating element 24. In one embodiment, the heating element 24 is an electrical heating element. In one embodiment, at least one supply conduit 14 and at least one return conduit 16 may be operably coupled to the HVAC component 12. In one embodiment, at least one supply flame arrestor 18*a* may be positioned within the supply air stream by disposing the at least one supply flame arrestor 18*a* within the at least one supply conduit 14. In one embodiment, at least one return flame arrestor 18*b* may be positioned within the return air stream by disposing the at least one return flame arrestor 18*b* within the at least one return conduit 16. To condition an interior space 19, a compressor (not shown) of the HVAC/R system 10 is fluidically coupled to the evaporator coil 20. Compressed refrigerant is configured to enter the evaporator coil 20 via a refrigerant supply line 26 and is configured to exit the evaporator coil 20 via a refrigerant return line 28. As the refrigerant flows through the evaporator coil 20, the fan 22 operates to circulate the conditioned air through the supply conduit 14 to the interior space 19. If auxiliary heating is needed, the heating element 24 energizes and the fan 22 operates to circulate air through the supply conduit 14 to the interior space 19. Air from the interior space 19 may enter the HVAC component 12 via the return conduit 16. It will be appreciated that the HVAC component 12 may be a combination of an evaporator coil and a furnace.

In the event that the refrigerant should leak from the evaporator coil 20, the refrigerant may migrate into one or both of the supply conduit 14, and the return conduit 16, depending on the orientation of the HVAC component 12, and/or if the fan 22 was operational during the leak. As such, a source of ignition may come from means other than the heating element 24. To quench the propagation of a flame should the refrigerant ignite, at least one supply flame arrestor 18*a* may disposed within the at least one supply conduit 14 and at least one return flame arrestor 18*b* may be disposed within the at least one return conduit 16.

A flame arrestor 18 generally functions by forcing a flame front through channels too narrow to permit the continuance of a flame via various mechanisms including heat loss and destruction of active radical species. It will be appreciated that the channels may be formed by a metal wire mesh, a narrow tube bundle, and/or a sheet metal plate with apertures formed therein, to name a few non-limiting examples. The open area, or free flow area, is the accumulative area of all of the channels of the at least one flame arrestor 18 expressed as a fraction of the entire surface area, $A_{total}$, of the at least one flame arrestor 18, and is defined by the formula:

$$A_{open}/A_{total}=(1-(\text{wire diameter}-\text{mesh spacing})^2)$$

In one embodiment, the at least one supply flame arrestor 18*a* includes an open area greater than 60%. In one embodiment, the at least one return flame arrestor 18*b* includes an open area greater than 60%.

Static pressure is the amount of resistance, measured in inches of water, produced when air is moved through an object like duct work. As the static pressure or resistance increases, the energy required to move air through the object similarly increases. As a result, the horsepower of the fan 22 of an HVAC/R system 10 must also be increased to overcome this increase in resistance. Inclusion of one or more flame arrestors 18*a*, 18*b* having an open area greater than 60% generally decreases the overall static pressure drop on the HVAC/R system 10.

Figure 2:
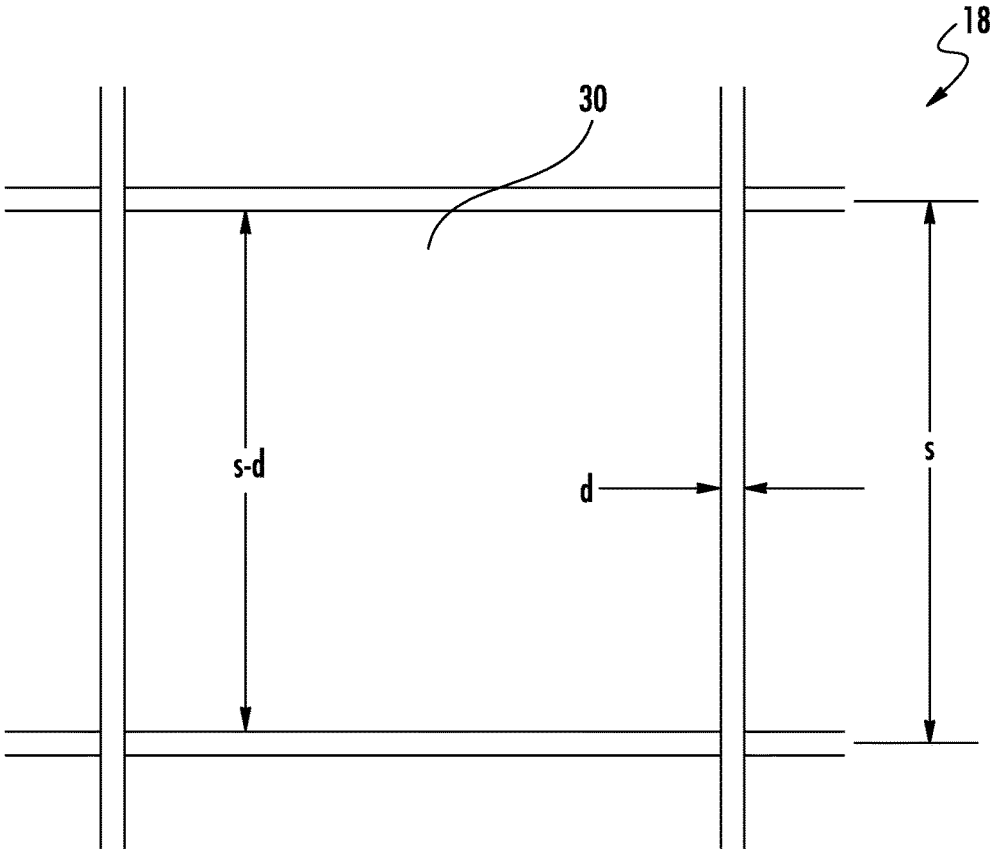
FIG. 2 is a schematic diagram of an example of a flame arrestor channel.

Referring now to FIG. 2, the mesh pitch 30 of the flame arrestor 18 is the size of each channel as defined by the formula:

$$\text{Mesh pitch}=(\text{mesh spacing}-\text{wire diameter})=(s-d)$$

In one embodiment, the at least one supply flame arrestor 18*a* includes a mesh pitch 30 of approximately 0.1 mm to 5 mm. In one embodiment, the at least one return flame arrestor 18*b* includes a mesh pitch 30 of approximately 0.1 mm to 5 mm:

The mesh pitch 30 of the at least one flame arrestor 18 may vary depending on the flammability properties of the refrigerant, the flow turbulence levels, the proportions of fuel and air present, and also the distance at which the flame arrestor 18 is placed from the ignition source. For example, a supply conduit 14, having a cross section of about 8×16 inches and a length of about 30 feet may contain a homogeneous, stoichiometric R32 (difluoromethane) air mixture throughout the supply conduit 14. A supply flame arrestor 18*a* disposed in the supply conduit 14 approximately one meter away from a leaked R32 (difluoromethane) refrigerant source adjacent to a competent ignition source may adequately quench a flame propagating from the ignition source using a mesh pitch 30 of approximately 1.1 mm. In another example, a supply flame arrestor 18*a* may be disposed in a supply conduit 14 containing a homogeneous R1234yf (2,3,3,3-tetrafluoro-1-propene) air throughout the supply conduit 14. The supply flame arrestor 18*a*, positioned approximately one meter away from a leaked R1234yf (2,3,3,3-tetrafluoro-1-propene) refrigerant source adjacent to a competent ignition source may adequately quench a flame propagating from the ignition source using a mesh pitch 30 of approximately 2 mm. In one embodiment, the at least one supply flame arrestor 18*a* and the at least one return flame arrestor 18*b* are positioned as close as possible to an ignition source to reduce the deflagration propagation velocity and therefore the resulting overpressure, and also reduce the amount of harmful combustion products that may pose a risk to occupants within an interior space 19, such as hydrofluoric acid (HF), for example.

In one embodiment, one or more of the at least one supply flame arrestor 18*a* and the at least one return flame arrestor 18*b* includes a metal mesh. In another embodiment, one or more of the at least one supply flame arrestor 18*a* and the at least one return flame arrestor 18*b* includes a non-flammable fiber. In another embodiment, one or more of the at least one supply flame arrestor 18*a* and the at least one return flame arrestor 18*b* includes a non-flammable porous material.

Figure 3:
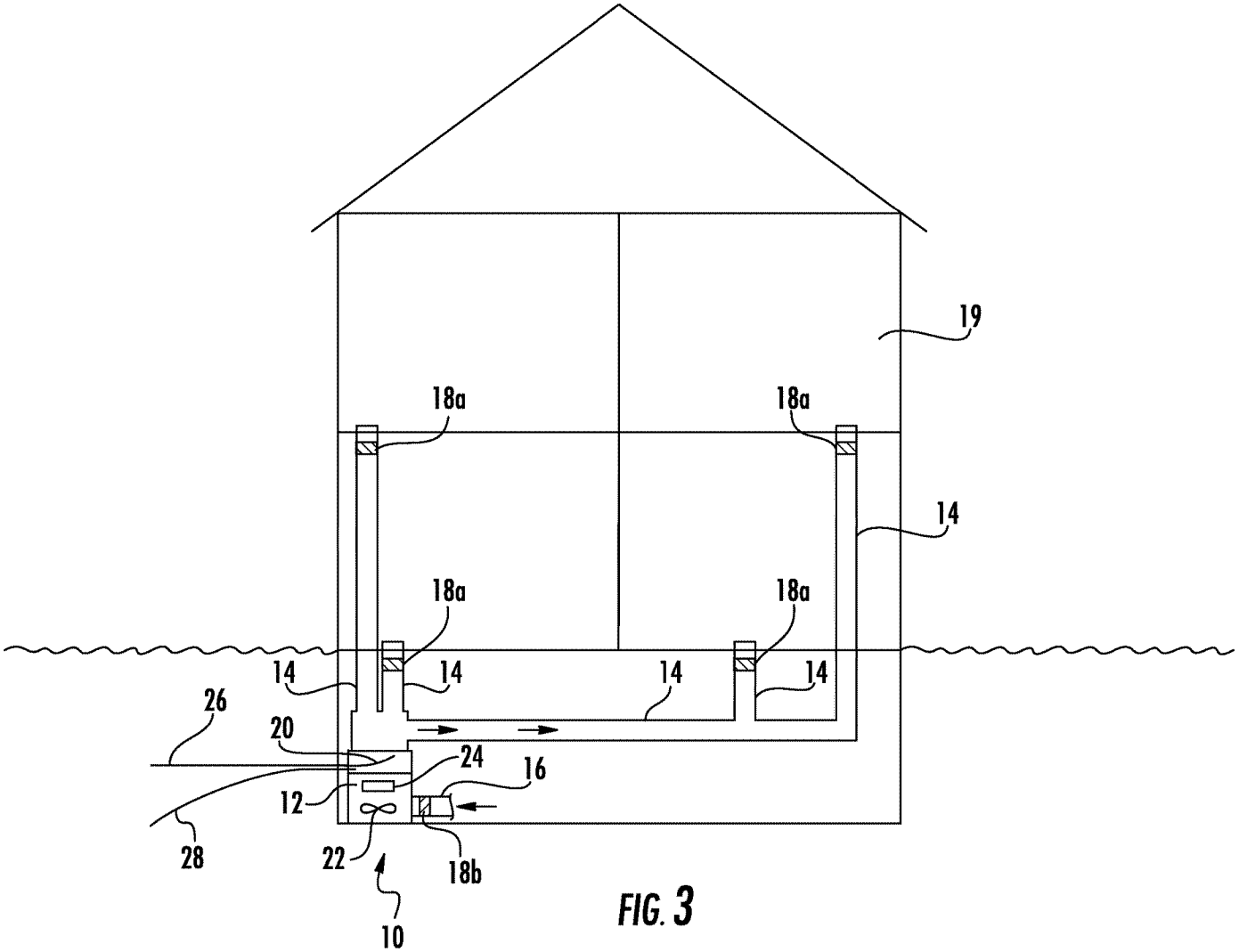
FIG. 3 is a schematic diagram of a HVAC/R system in another embodiment.

FIG. 3 illustrates another embodiment of the HVAC/R system 10. As shown, HVAC component 12 is a combination of a furnace and an evaporator coil 20. The furnace includes a fan 22, and a heating element 24. Exemplary heating elements 24 include, but are not limited to a pilot flame, produced by natural gas, heating oil, or propane, or an electric heating element or coil. Operably coupled to the HVAC component 12 are a plurality of supply conduits 14. Each of the supply conduits 14 directs conditioned air throughout the interior space 19. A return conduit 16 is operably coupled to the HVAC component 12 to direct air from the interior space 19 into the HVAC component 12. Disposed within each of the plurality of supply conduits 14 may be at least one supply flame arrestor 18*a*. Disposed within the return conduit 16 may be a return flame arrestor 18*b*. It will be appreciated that a supply flame arrestor 18*a* is positioned within each of the plurality of supply conduits 14 to quench the propagation of a flame within the plurality of supply conduits 14 or into the interior space 19. It will also be appreciated that the HVAC/R system 10 may include more than one return conduit 16.

Figure 4:
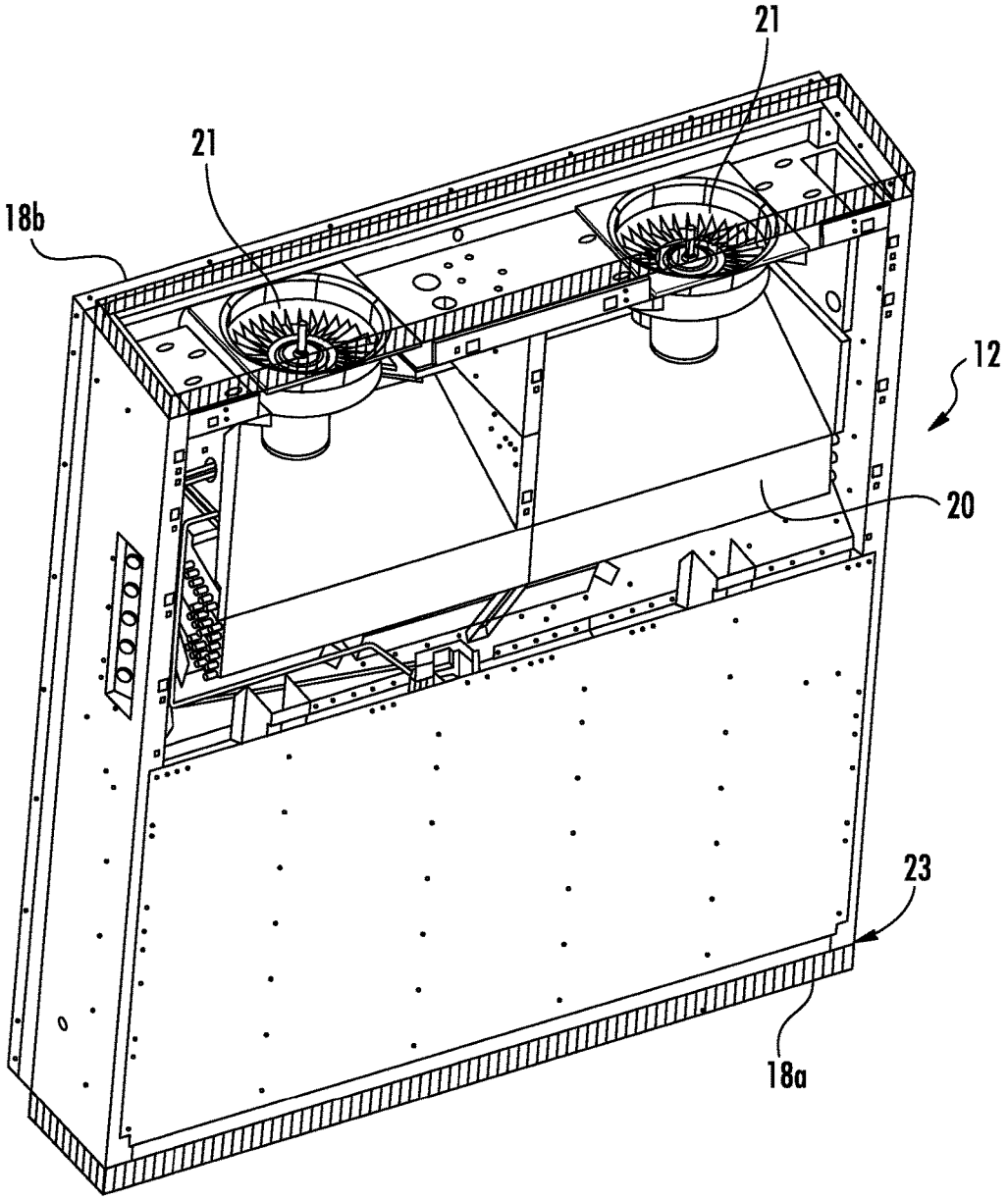
FIG. 4 is a schematic diagram of a HVAC/R system in another embodiment.

FIG. 4 illustrates another embodiment of the HVAC/R system 10. As shown, HVAC component 12 may be a refrigeration unit including an evaporator coil 20, at least one return air intake fan 21, at least one supply air channel 23, and a compressor (not shown). In one embodiment, the at least one return air intake fan 21 is positioned within the return air stream, and the at least one supply air channel 23 is positioned within the supply air stream. In one embodiment, the at least one supply flame arrestor 18*a* is positioned in the supply air stream by positioning the at least one supply arrestor 18*a* adjacent to the at least one supply air channel 23. In one embodiment, the at least one return flame arrestor 18*b* is positioned in the return air stream by positioning the at least one return arrestor 18*b* adjacent to the at least one return air intake fan. Generally, to refrigerate an interior of a container or a truck trailer, the compressor (not shown) compresses the refrigerant and the compressed refrigerant circulates through the evaporator coil 20 via a refrigerant line (not shown). As the refrigerant flows through the evaporator coil 20, the at least one return air intake fan 21 operates to pull air from the return air stream through the refrigeration unit 12 across the evaporator coil 20. The conditioned air enters the supply air stream where it may be directed through the at least one supply air channel 23. It will be appreciated that a supply flame arrestor 18*a* is positioned adjacent to the at least one supply air channel 23 and adjacent to the at least one return air intake fan 21 to reduce the likelihood of a flame initiated inside the HVAC component 12 from propagating into the interior of the container or the truck trailer compartment.

It will be appreciated that, positioning a supply flame arrestor 18*a* within the supply air stream and positioning a return flame arrestor 18*b* within the return air stream will reduce the likelihood of flame propagation within the at least one supply conduit 14, within the at least one return conduit 16, and to any particular area of the interior space 19 should a combustion event occur within the supply air stream and/or return conduits. It will be appreciated that, positioning a supply flame arrestor 18*a* within the supply air stream and positioning a return flame arrestor 18*b* within the return air stream will reduce the likelihood of flame propagation into the interior of the container or the truck trailer compartment.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A heating, ventilation, air conditioning, and refrigeration system comprising: an HVAC component configured to allow a refrigerant to flow therethrough; at least one supply flame arrestor positioned within a supply air stream; and at least one return flame arrestor positioned within a return air stream, wherein each of the at least one supply flame arrestor and each of the at least one return flame arrestor includes a mesh pitch of approximately 0.1 mm to 5 mm.

2. The heating, ventilation, air conditioning, and refrigeration system of claim 1, wherein the at least one supply flame arrestor includes an open area greater than 60%.

3. The heating, ventilation, air conditioning, and refrigeration system of claim 1, wherein the at least one return flame arrestor includes an open area greater than 60%.

4. The heating, ventilation, air conditioning, and refrigeration system of claim 1, wherein the at least one supply flame arrestor comprises a metal mesh.

5. The heating, ventilation, air conditioning, and refrigeration system of claim 1, wherein the at least one return flame arrestor comprises a metal mesh.

6. The heating, ventilation, air conditioning, and refrigeration system of claim 1, wherein the at least one supply flame arrestor comprises a non-flammable fiber.

7. The heating, ventilation, air conditioning, and refrigeration system of claim 1, wherein the at least one return flame arrestor comprises a non-flammable fiber.

8. The heating, ventilation, air conditioning, and refrigeration system of claim 1, wherein the at least one supply flame arrestor comprises a non-flammable porous material.

9. The heating, ventilation, air conditioning, and refrigeration system of claim 1, wherein the at least one return flame arrestor comprises a non- flammable porous material.

10. The heating, ventilation, air conditioning, and refrigeration system of claim 1, wherein the HVAC component comprises an evaporator coil operably coupled to a furnace.

11. The heating, ventilation, air conditioning, and refrigeration system of claim 10, wherein at least one supply conduit and at least one return conduit are operably coupled to the HVAC component.

12. The heating, ventilation, air conditioning, and refrigeration system of claim 11, wherein the at least one supply flame arrestor is positioned within the supply air stream by disposing the at least one return flame arrestor within the at least one return conduit.

13. The heating, ventilation, air conditioning, and refrigeration system of claim 11, wherein the at least one return flame arrestor is positioned within the return air stream by disposing the at least one return flame arrestor within the at least one return conduit.

14. The heating, ventilation, air conditioning, and refrigeration system of claim 11, wherein the at least one supply conduit comprises a plurality of supply conduits.

15. The heating, ventilation, air conditioning, and refrigeration system of claim 10, wherein the furnace comprises:

an enclosure;

a fan disposed within the enclosure; and a heating element disposed within the enclosure;

wherein the heating element is selected from a group consisting of a flame and an electrical heating element.

16. The heating, ventilation, air conditioning, and refrigeration system of claim 1, wherein the HVAC component comprises a fan coil.

17. The heating, ventilation, air conditioning, and refrigeration system of claim 16, wherein at least one supply conduit and at least one return conduit are operably coupled to the HVAC component.

18. The heating, ventilation, air conditioning, and refrigeration system of claim 17, wherein the at least one supply flame arrestor is positioned within the supply air stream by disposing the at least one return flame arrestor within the at least one return conduit.

19. The heating, ventilation, air conditioning, and refrigeration system of claim 17, wherein the at least one return flame arrestor is positioned within the return air stream by disposing the at least one return flame arrestor within the at least one return conduit.

20. The heating, ventilation, air conditioning, and refrigeration system of claim 17, wherein the at least one supply conduit comprises a plurality of supply conduits.

21. The heating, ventilation, air conditioning, and refrigeration system of claim 16, wherein the fan coil comprises:

an enclosure;

an evaporator coil disposed within the enclosure;

a fan disposed within the enclosure; and a heating element disposed within the enclosure;

wherein the heating element comprises an electrical heating element.

22. The heating, ventilation, air conditioning, and refrigeration system of claim 1, wherein the HVAC component comprises a refrigeration unit.

23. The heating, ventilation, air conditioning, and refrigeration system of claim 22, wherein the refrigeration unit comprises:

an enclosure;

at least one return air intake fan disposed with the enclosure;

at least one supply air channel disposed within the enclosure;

a compressor disposed within the enclosure; and an evaporator coil disposed within the enclosure;

wherein the at least one return air intake fan is positioned within the return air stream;

wherein the at least one supply air channel is positioned within the supply air stream.

24. The heating, ventilation, air conditioning, and refrigeration system of claim 23, wherein the at least one supply flame arrestor is positioned in the supply air stream by positioning the at least one supply flame arrestor adjacent to the at least one supply air channel.

25. The heating, ventilation, air conditioning, and refrigeration system of claim 23, wherein the at least one return flame arrestor is positioned in the return air stream by positioning the at least one return flame arrestor adjacent to the at least return air intake fan.

26. The heating, ventilation, air conditioning, and refrigeration system of claim 1, wherein the refrigerant comprises a flammable refrigerant.

27. The heating, ventilation, air conditioning, and refrigeration system of claim 26, wherein the flammable refrigerant comprises difluoromethane.

28. The heating, ventilation, air conditioning, and refrigeration system of claim 26, wherein the flammable refrigerant comprises 2,3,3,3-tetrafluoro-1-propene.

29. The heating, ventilation, air conditioning, and refrigeration system of claim 1, wherein the at least one supply flame arrestor and at least one return flame arrestor are each configured to force a flame through a plurality of channels.

* * * * *